US008294618B2

(12) United States Patent
Lee et al.

(10) Patent No.: US 8,294,618 B2
(45) Date of Patent: Oct. 23, 2012

(54) MULTIBAND ANTENNA

(75) Inventors: Yi-Chieh Lee, Tu-Cheng (TW); Tun-Yuan Tsou, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 454 days.

(21) Appl. No.: 12/693,639

(22) Filed: Jan. 26, 2010

(65) Prior Publication Data

US 2010/0277390 A1 Nov. 4, 2010

(30) Foreign Application Priority Data

Apr. 30, 2009 (CN) ..... 2009 1 0302041

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS 5,903,240 A * 5/1999 Kawahata et al. ..... 343/700 MS
6,121,930 A * 9/2000 Grangeat et al. ..... 343/700 MS
6,784,843 B2 * 8/2004 Onaka et al. ..... 343/700 MS
7,126,544 B2 * 10/2006 Liu et al. ..... 343/700 MS

* cited by examiner

*Primary Examiner* — Hoanganh Le
(74) *Attorney, Agent, or Firm* — Altis Law Group, Inc.

(57) ABSTRACT

A multiband antenna includes a first antenna unit and a second antenna unit. The first antenna unit includes a first radio member and a second radio member connected to the first radio member. The second antenna unit includes a third radio member and a fourth radio member connected to the third radio member. The first antenna unit receives/sends wireless signals at relatively higher frequencies; the second antenna unit receives/sends wireless signals at relatively lower frequencies.

13 Claims, 3 Drawing Sheets

MULTIBAND ANTENNA

BACKGROUND

1. Technical Field

The present disclosure relates to multiband antennas, and particularly to a multiband antenna used in portable electronic devices.

2. Description of Related Art

Portable electronic devices, such as mobile phones, personal digital assistants (PDA), and laptop computers, have mounted antennas for receiving/sending wireless signals. Commonly, a portable electronic device may receive/send wireless signals of different frequencies, and that necessitates a multiband antenna.

However, multiband antennas tend to be large and have complicated structures, making it difficult to miniaturize portable electronic devices. Even where installation of miniaturized multiband antennas within such portable devices is possible, achieving precision is a challenge. The resultant casualty often is communication quality. Additionally, multiband antennas generally generate more electromagnetic radiation than single-banded antennas. Portable electronic devices employing multiband antennas may have high electromagnetic wave specific absorption rates (SAR).

Therefore, there is room for improvement within the art.

BRIEF DESCRIPTION OF THE DRAWINGS

Many aspects of the present multiband antenna can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 1:
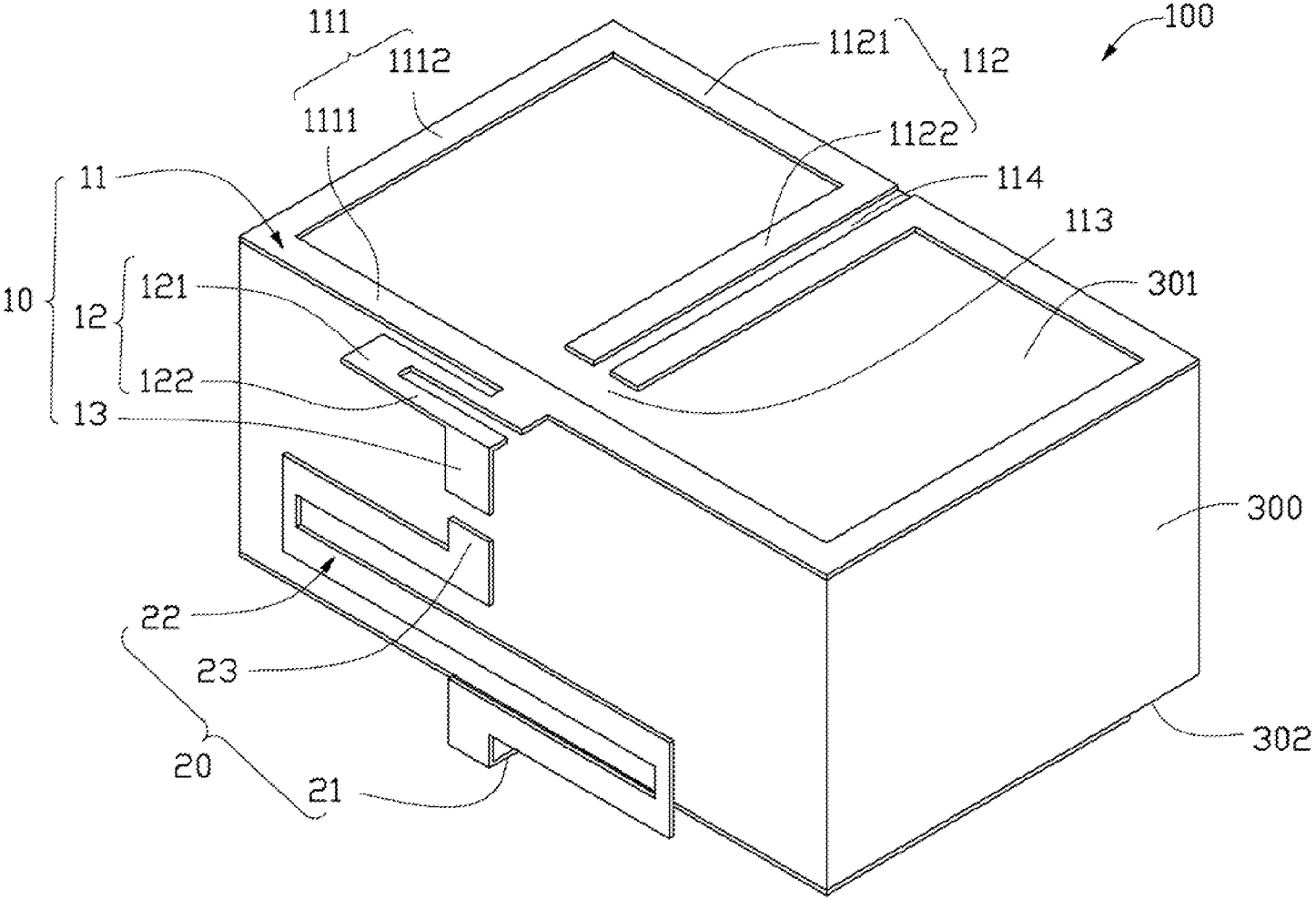
FIG. 1 is a schematic view of a multiband antenna, according to an exemplary embodiment.
Figure 2:
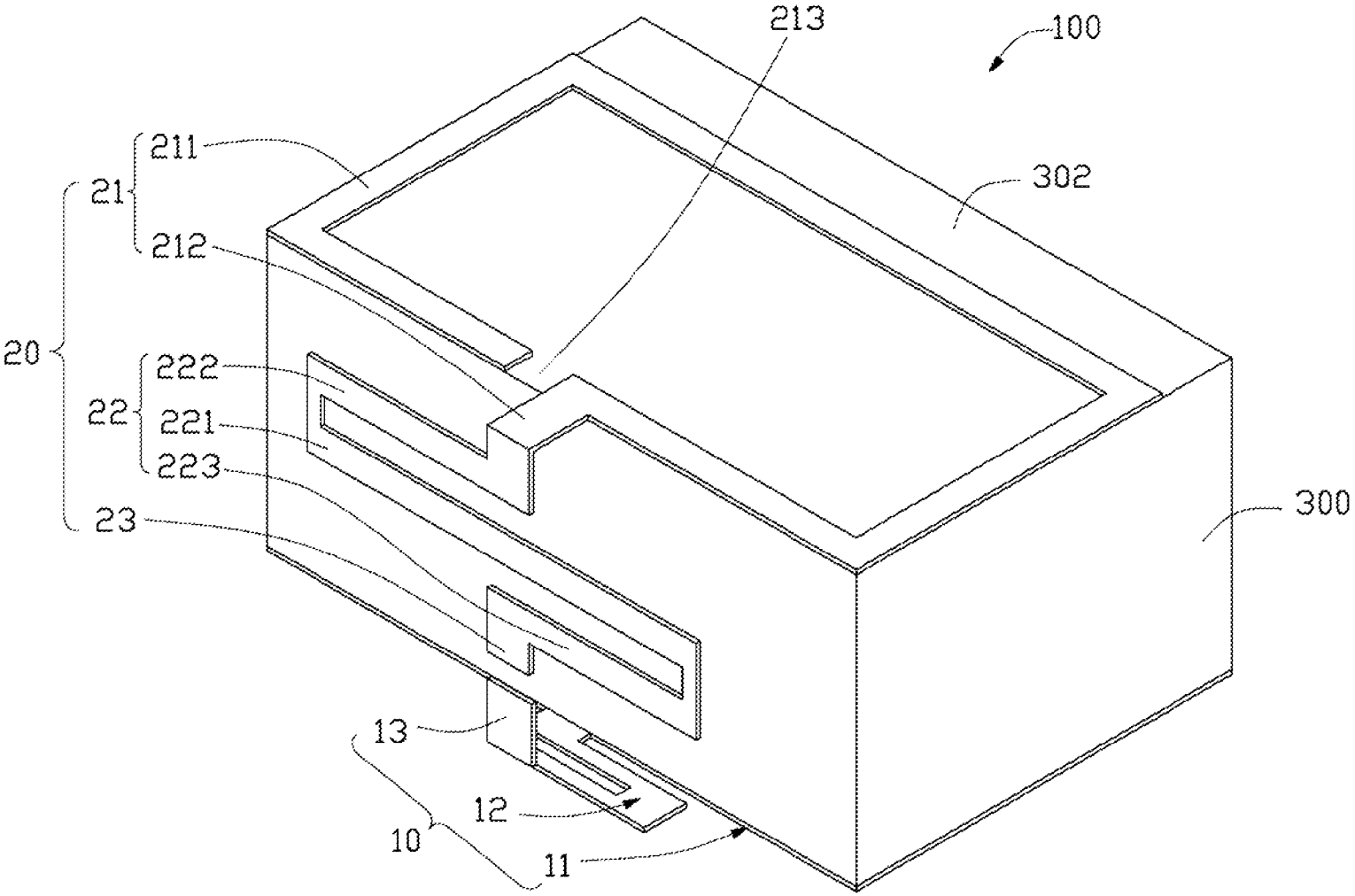
FIG. 2 is a schematic view of the multiband antenna shown in FIG. 1, shown in another view angle.

FIG. 1 and FIG. 2 schematically show a multiband antenna 100, according to an exemplary embodiment. The multiband antenna 100 is made of sheets made of conductive materials. The multiband antenna 100 includes a first antenna unit 10 and a second antenna unit 20 capable of serving as a ground resonator of the first antenna unit 10. The antenna units 10, 20 may be supported on a cubic substrate 300, as described below. The first antenna unit 10 is used to receive or send wireless signals at a relatively higher frequency, and the second antenna unit 20 is used to receive or send wireless signals at a relatively lower frequency.

The first antenna unit 10 includes a first radio member 11, a second radio member 12, and a feed member 13. The first radio member 11 is a planar sheet that includes a first radio portion 111 and two second radio portions 112. The first radio portion 111 and the two second radio portions 112 are coplanar. The first radio portion 111 includes a longitudinal main section 1111 and two longitudinal arm sections 1112. The two arm sections 1112 are respectively perpendicularly connected to two ends of the main section 1111, and extend away from the main section 1111 in a same direction. Each second radio portion 112 is an L-shaped sheet that includes a first extending section 1121 and a second extending section 1122. The first extending section 1121 and the second extending section 1122 are both longitudinal sheets. The first extending sections 1121 of the two second radio portions 112 are respectively perpendicularly connected to ends of the two arm sections 1112, and extend parallel to the main section 1111 toward each other. The second extending sections 1122 of the two second radio portions 112 are respectively perpendicularly connected to ends of the two first extending sections 1121, and extend toward the main section 1111. Spaces 113 are respectively formed between the ends of the two second extending sections 1122 and the main section 1111. A first gap 114 is formed between the two second extending sections 1122.

The second radio member 12 is an approximately U-shaped planar sheet positioned coplanar with the first radio member 11. The second radio member 12 includes a rectangular first connecting portion 121 and two longitudinal arm portions 122. The two arm portions 122 are perpendicularly connected to a same side of the first connecting portion 121 and extend parallel to each other. The second radio member 12 and the arm sections 1112 are respectively connected to two opposite sides of the main section 1111. The middle portion of the main section 1111 is connected to an outer side of the end of one arm portion 122, and the arm portions 122 are positioned parallel to the main section. The feed member 13 is a rectangular planar sheet positioned perpendicular to the plane in which the first radio member 11 and the second radio member 12 are positioned. The feed member 13 is perpendicularly connected to an outer side of the end of another arm portion 122.

The second antenna unit 20 includes a third radio member 21, a fourth radio member 22, and an extending member 23. The third radio member 21 is a planar sheet positioned parallel to the first radio member 11 and the second radio member 12. The third radio member 21 includes a third radio portion 211 and a second connecting portion 212. The third radio portion 211 is a rectangular frame that defines a second gap 213 in the middle of a side thereof. The second connecting portion 212 is a rectangular planar sheet coplanar with the second main radio portion 211. One side of the second connecting portion 212 is connected to an outer side of the main portion 211 adjacent to the second gap 213.

The fourth radio member 22 is a planar sheet positioned coplanar with the feed member 13. The fourth radio member 22 is perpendicularly connected to the end of the second connecting portion 212. The fourth radio member 22 includes a fourth radio portion 221, a fifth radio portion 222, and a sixth radio portion 223. The fourth radio portion 221, the fifth radio portion 222, and the sixth radio portion 223 are all longitudinal planar sheets. The fourth radio portion 221 extends parallel to the plane in which the third radio member 21 is positioned and the plane in which the first radio member 11 and the second radio member 12 are positioned. The fifth radio portion 222 and the sixth radio portion 223 are respectively positioned at two sides of the fourth radio portion 221 and connected to two ends of the fourth radio portion 221. The main parts of the fifth radio portion 222 and the sixth radio portion 223 both extend parallel to the fourth portion 221. One end of the fifth radio portion 222 is bent to be perpendicularly connected to one end of the fourth radio portion 221, and another end of the fifth radio portion 222 is bent to be perpendicularly connected to the second connecting portion 212. One end of the sixth radio portion 223 is bent to be perpendicularly connected to another end of the fourth radio portion 221, and the other end of the sixth radio portion 223 perpendicularly extends away from the fourth radio portion 221 to form the extending member 23. The extending member 23 is a rectangular sheet. The feed member 13, the extending member 23, and the end of the fifth radio portion 222 connected to the second connecting portion 212 are aligned with each other.

Also referring to FIG. 1 and FIG. 2, the multiband antenna 100 can be supported and protected on a cubic substrate 300. The substrate 300 includes a first surface 301, an opposite second surface 302 parallel to the first surface 301, and four side surfaces (not labeled) perpendicularly connected between the first surface 301 and the second surface 302. During assembly, the first radio member 11 and the second radio member 12 are attached on the first surface 301, and on identical planes. The third radio member 21 is attached on the second surface 302. The feed member 13, the fourth radio member 22, and the extending member 23 can be positioned parallel to a side surface of the substrate 300 or attached to a side surface of the substrate 300. Thus, each portion of the multiband antenna 100 can be flatly attached on the substrate 300, and an outer shape of an assembly including the substrate 300 and the multiband antenna 100 mounted thereon is also approximately cubic. Accordingly, the multiband antenna 100 is protected from damage, and assembly, installation, and transportation of the multiband antenna 100 are simplified.

The multiband antenna 100 can be used in portable electronic devices, such as mobile phones, PDA's, or laptop computers. In use, the second surface 302 of the substrate 300 can be attached to a circuit board (not shown) of a portable electronic device. The second antenna unit 20 is connected to the circuit board by the third radio member 21 and is grounded via the circuit board, and the feed member 13 is connected to a feed circuit (not shown) of the portable electronic device. Upon feed signals being input to the feed member 13, the first antenna unit 10 can be used to receive/send wireless signals at relatively higher frequencies. Simultaneously, the second antenna unit 20 can serve as a ground resonator and receive/send wireless signals at relatively lower frequencies.

Figure 3:
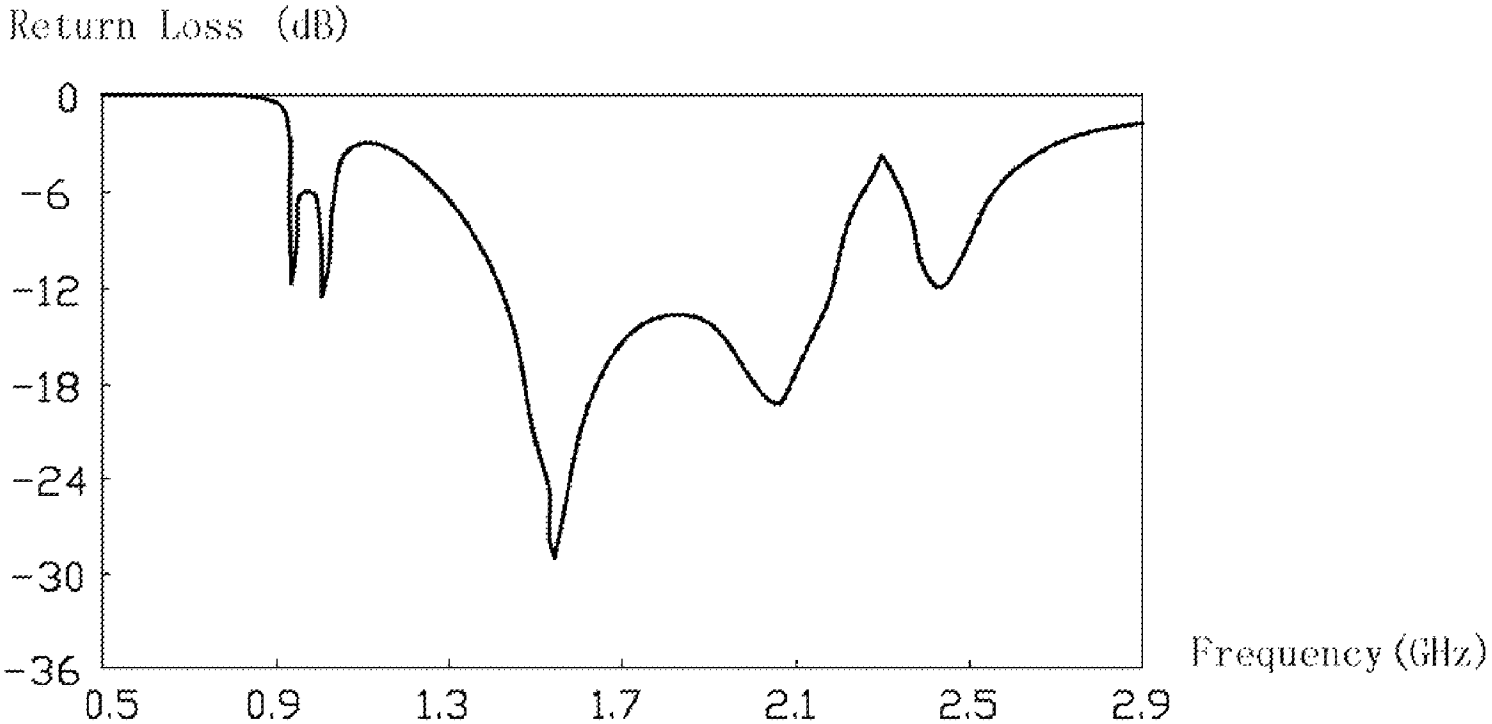
FIG. 3 is a diagram of measuring a return loss (RL) of the multiband antenna shown in FIG. 1.

Also referring to FIG. 3, as known in experiments, in many frequency bands between about 0.9 GHz to 2.5 GHz, the return loss (RL) multiband antenna 100 is acceptable. Thus, the multiband antenna 100 can be used in many conventional wireless communication systems having different working frequencies, such as GSM (i.e., at working frequencies of about 0.9 GHz), GPS (i.e., at working frequencies of about 1.575 GHz), and WIFI (i.e., at working frequencies of about 2.4 GHz-2.5 GHz).

Additionally, in the multiband antenna 100, the plane in which the first radio member 11 and the second radio member 12 are positioned and the plane in which the third radio member 21 is positioned are parallel to each other. Thus, the working currents generated in the first radio member 11 and the second radio member 12 (i.e., the main part of the first antenna unit 10) and the working currents generated in the third radio member (i.e., the main part of the second antenna unit 20) are separated from each other. Accordingly, the working currents of the multiband antenna 200 are prevented from becoming excessively dense, and thus the electromagnetic wave specific absorption rates (SAR) of the multiband antenna 100 can be decreased. In contrast to conventional multiband antennas, the multiband antenna 100 generates less electromagnetic radiation.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a first antenna unit, the first antenna unit including a first radio member and a second radio member connected to the first radio member, the first radio member and the second radio member being coplanar sheets; and a second antenna unit, the second antenna unit including a third radio member and a fourth radio member connected to the third radio member, the third radio member being a sheet positioned parallel to the first radio member and the second radio member, and the fourth radio member is a sheet positioned perpendicular to the first radio member, the second radio member and the third radio member; wherein the first antenna unit receives/sends wireless signals at relatively higher frequencies, the second antenna unit receives/sends wireless signals at relatively lower frequencies; and wherein the first radio member includes a longitudinal main section, and the second radio member includes a rectangular first connecting portion and two longitudinal arm portions, the two arm portions perpendicularly connected to a same side of the first connecting portion and extending parallel to each other, a middle portion of the main section connected to an outer side of the end of one arm portion, and the arm portions positioned parallel to the main section.

2. The multiband antenna as claimed in claim 1, wherein the first antenna unit further includes a feed member for obtaining feed signals, and the feed member is connected to the second radio member.

3. The multiband antenna as claimed in claim 2, wherein the second antenna unit serves as a ground resonator when feed signals are input to the feed member.

4. The multiband antenna as claimed in claim 2, wherein the feed member is a sheet positioned coplanar with the fourth radio member.

5. The multiband antenna as claimed in claim 4, wherein the second antenna unit further includes an extending member connected to the fourth radio member.

6. The multiband antenna as claimed in claim 5, wherein the extending member is a sheet positioned coplanar with the fourth radio member and is aligned with the feed member.

7. The multiband antenna as claimed in claim 5, wherein the first radio member includes a first radio portion and two second radio portions; the first radio portion including the main section and two longitudinal arm sections, the arm sections respectively perpendicularly connected to two ends of the main section and extending towards to a same side of the main section; each second radio portion including a longitudinal first extending section and a longitudinal second extending section, the first extending sections of the two second radio portions respectively perpendicularly connected to ends of the two arm sections and extending parallel to the main section and towards each other, the second extending sections of the two second radio portions respectively perpendicularly connected to ends of the two first extending sections and extending towards the main section.

8. The multiband antenna as claimed in claim 7, wherein the feed member is perpendicularly connected to an outer side of the end of another arm portion.

9. The multiband antenna as claimed in claim 5, wherein the third radio member includes a third radio portion and a second connecting portion, the third radio portion being a rectangular frame that defines a gap in the middle of a side thereof, the second connecting portion being a rectangular sheet, one side of the second connecting portion connected to an outer side of the main portion that is adjacent to the gap.

10. The multiband antenna as claimed in claim 9, wherein fourth radio member is perpendicularly connected to the second connecting portion and includes a fourth radio portion, a fifth radio portion, and a sixth radio portion, which are all longitudinal sheets; the fourth radio portion extending parallel to the plane in which the third radio member is positioned and the plane in which the first radio member and the second radio member are positioned, the fifth radio portion and the sixth radio portion respectively positioned at two sides of the fourth radio portion and connected to two ends of the fourth radio portion.

11. The multiband antenna as claimed in claim 10, wherein the main parts of the fifth radio portion and the sixth radio portion both extends parallel to the fourth portion; one end of the fifth radio portion is connected to one end of the fourth radio portion, and another end of the fifth radio portion is connected to the second connecting portion; one end of the sixth radio portion is connected to another end of the fourth radio portion, and the other end of the sixth radio portion extends away from the fourth radio portion to form the extending member.

12. The multiband antenna as claimed in claim 5, wherein the multiband antenna is supported on a cubic substrate, the substrate including a first surface, an opposite second surface parallel to the first surface, and four side surfaces perpendicularly connected between the first surface and the second surface; the first radio member and the second radio member attached on the first surface, the third radio member attached on the second surface.

13. The multiband as claimed in claim 12, wherein the feed member, the fourth radio member, and the extending member are positioned parallel to a side surface of the substrate or attached on the side surface.

* * * * *